US011054211B1

(12) United States Patent
Stone

(10) Patent No.: US 11,054,211 B1
(45) Date of Patent: Jul. 6, 2021

(54) ELECTROMAGNETIC LAUNCHER

(71) Applicant: Peter Stone, Brooklyn, NY (US)

(72) Inventor: Peter Stone, Brooklyn, NY (US)

( * ) Notice: Subject to any disclaimer, the term of this patent is extended or adjusted under 35 U.S.C. 154(b) by 0 days.

(21) Appl. No.: 16/873,363

(22) Filed: Mar. 27, 2020

(51) Int. Cl.
*F41B 6/00* (2006.01)

(52) U.S. Cl.
CPC ..... *F41B 6/003* (2013.01)

(58) Field of Classification Search
CPC ..... F41B 6/00; F41B 6/003; F41B 6/006
See application file for complete search history.

(56) References Cited

U.S. PATENT DOCUMENTS 1,241,333 A * 9/1917 Bowman ..... F41B 6/00 124/3
4,274,136 A * 6/1981 Onodera ..... H01F 27/306 336/185
4,854,215 A * 8/1989 Jasper, Jr. ..... F41B 6/006 89/8
4,864,911 A * 9/1989 McKee ..... F41B 6/006 89/8
4,870,888 A * 10/1989 Weldon ..... F41B 6/00 89/8
4,901,621 A * 2/1990 Tidman ..... F41B 6/006 102/520
5,158,291 A * 10/1992 Biagi ..... A63F 7/3075 273/118 A
6,725,759 B1 * 4/2004 Kathe ..... F41B 6/00 124/3
7,077,046 B2 * 7/2006 Nelyubin ..... F41B 6/003 124/3
8,237,526 B2 * 8/2012 Putman ..... F41J 13/00 335/219
8,677,878 B1 * 3/2014 Floyd ..... F41B 6/003 89/8
9,354,019 B2 * 5/2016 Gonzaga ..... F41B 6/006
9,784,523 B2 * 10/2017 Grace ..... F41B 6/003
10,928,157 B1 * 2/2021 Busch, II ..... F41B 6/003
2005/0280316 A1 * 12/2005 Nozawa ..... H02K 41/03 310/12.22
2008/0150374 A1 * 6/2008 Chang ..... H02K 41/02 310/12.22

* cited by examiner

*Primary Examiner* — Joshua T Semick
(74) *Attorney, Agent, or Firm* — Joshua Kaplan, Esq.; Kaplan Law Practice, LLC

(57) ABSTRACT

The electromagnetic launcher with at least two power coils spaced from each other along an axis substantially coextensive with an intended trajectory of non-conductive, non-magnetic projectile with a projectile winding shorted by a diode. The power coils to inductively couple a magnetic flux to the projectile winding. A non-magnetic, electrically conductive electromagnetic shield positioned inside to each of power coils. Each shield has a central opening and at least one radial cut. The power coils with shields in this position keep holding by non-conductive, non-magnetic holder with the same size of central opening as the central openings of shields. A diameter of central opening is less than inner diameter of power coils and more than outer diameter of projectile. Circuit means connected to power coils for selectively and sequentially applying pulse voltages to power coils to excite the projectile winding and accelerate the projectile by pushing and pulling electromagnetic forces simultaneously.

3 Claims, 3 Drawing Sheets

ELECTROMAGNETIC LAUNCHER

BACKGROUND OF THE INVENTION

1. Field of the Invention

The present invention relates to electromagnetic launchers in general, and, more particularly, to electromagnetic launchers with induction coils therefore.

2. Description of the Prior Art

An electromagnetic launcher (EL) based on induction coil gun technology comprises coil electromagnet. The coils are sequentially arranged along a launch tube to accelerate a projectile to a desired velocity for launch. The coils are powered on and off in sequence to accelerate the projectile and expel it out of the launch tube. The sequentially-arranged coils and their accompanying circuits are commonly known as the "stages" of the coil gun. See, for example, U.S. Pat. No. 8,677,878. The projectile is also provided with a cylindrical powered winding to increase the accelerating force.

The acceleration is achieved through induction and magnetic forces. A coilgun provides no physical contact between the projectile and the propulsion coil. The coilgun acts as a linear induction motor with respect to the projectile. In any induction motor without a magnetic core the active component of the current is much less than the magnetizing current. Therefore, with allowable current densities in the coils, the magnetic induction does not exceed 1-2 Tesla. This is not enough to create an effective electromagnetic launcher.

SUMMARY OF IRE INVENTION

The accelerating projectile force is proportional to the square of the density of the magnetic flux. Therefore, the goal of the present invention is to increase the magnetic induction by tens and even hundreds of times. This goal is achieved by using Francis Bitter magnet which was invented in 1933. But before this magnet use it must be modified.

Modified Bitter Magnet (MBM) consists of a power coil and a non-magnetic ($\mu r=1$), electrically conductive electromagnetic shield coaxially located inside the power coil.

The electromagnetic shield is provided with a central opening having a diameter dimensioned to freely pass the projectile, and having at least one radial cut that prevents the flow of eddy currents within the electromagnetic shield around the axis.

Internal diameter of the power coil more than diameter of central opening of electromagnetic shield.

The magnetic field created by the pulsed current of the power coil, at the first moment can be passed only through the central opening of the electromagnetic shield due to the eddy currents in the electromagnetic shield.

In this case, the magnetic flux density will be greater than that without the electromagnetic shield as many times as much as the area limited by the internal diameter of the power coil is larger than the cross-sectional area of the central opening of the electromagnetic shield.

External diameter of a non-conductive, non-magnetic projectile with a projectile winding shorted by a diode is less than diameter of central opening of the electromagnetic shield.

The electromagnetic launcher according to the present invention contains at least two MBMs spaced from each other along the axis substantially coextensive with an intended trajectory of the projectile and fixedly supported by non-conductive ($\sigma[1/\Omega]=0$), non-magnetic ($\mu r=1$) holder with the same size of central opening as the electromagnetic shield.

Circuit means to connect pulse power sources to power coils for selectively and sequentially applying pulse voltages to power coils, firstly, for pulsed excitation of the projectile winding and, secondly, to accelerate the projectile.

Firstly, to excite the projectile winding the projectile must be axially aligned with first power coil, A pulse voltage is applied to first power coil and increasing current flows through first power coil is created an increasing magnetic flux flowing through the projectile winding, Direction of the projectile winding turns and the polarity of the diode in the projectile winding circuit are such that an electromotive force arises in the winding of the projectile in this case is against the diode and the current in the projectile winding will not flow.

After the current in the first coil reaches its maximum value, this current and the magnetic flux created by it begin to decrease, which will lead to a change in the sign of the electromotive force in the projectile winding, Under the influence of this electromotive force, a current will flow in the projectile winding. In other words, part of the ampere turns of the first coil will be pulsed transferred to the projectile winding. This current will be held during the entire process of accelerating the projectile.

Indeed, the winding time constant is defined as $\tau=L/R$, where L and R are the inductive and active resistance of the winding, By cooling the winding projectile to the temperature of nitrogen or helium, it is possible to increase $\tau$ to the desired values.

Secondly, after exciting the projectile winding, two pulse voltages are applied to first and second power coils simultaneously, to accelerate the projectile. The pulse polarity for first power coil is opposite to the polarity of voltage pulse for first coil, which was used to excite the projectile winding, and polarity of pulse voltage for second power coil is opposite to polarity of pulse voltages for first coil.

The currents in the first and second power coils, as well as the current in the projectile winding, create electromagnetic forces that accelerate the projectile. Between the first power coil and the projectile winding a pushing electromagnetic force is arisen and between the second power coil and the projectile winding a pulling electromagnetic force is arisen thereby accelerating the projectile by pushing and pulling electromagnetic force simultaneously. Therefore, this type of EL will be called the Pushing-Pulling Electromagnetic Launcher (PPEL).

Instead of the diode in the circuit of projectile winding any suitable switch may be used to short the projectile winding at the moment of maximum magnetic flux inside of the projectile.

Without ferromagnetic cores, electromagnetic forces are applied to parts of the device with currents. In this case, these are the power coils, the projectile windings and the electromagnetic shields with eddy currents. The monolithic connection of the power coil and the electromagnetic shield simplifies their connection with the holders. Therefore, each electromagnetic shield consists of two identical electromagnetic disk shields with flange. The disk shields are mounted on the sides of the power coil and the flanges keep holding the power coil inside of assembled electromagnetic shield. The cuts of two adjacent disk shields are 180 degrees offset from each other.

See priority application U.S. 62/921,430 at Jun. 17, 2019.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1A:
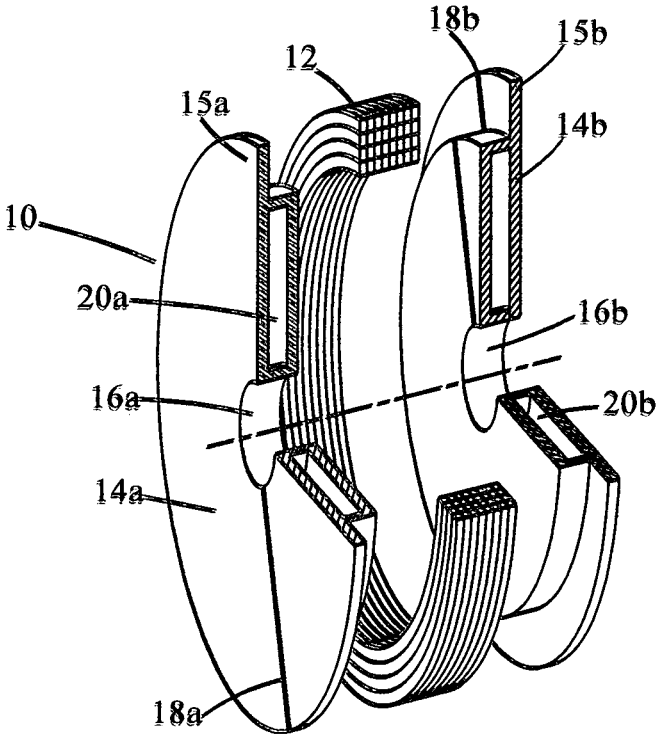
FIG. 1A illustrates a transverse cross-section of parts a Modified Bitter Magnet (MBM) with two electromagnetic disk shields with flange each.

Modified Bitter Magnet (MBM) is generally designated by the reference numeral 10, see FIGS. lA and 1B, The MBM 19 used in the design of the invention has been modified as follows: instead of disk windings for regular Bitter Magnet, the coil 12 and an electromagnetic shied 13 consist of two identical disk shields 14*a*, 14*b* with flange 15*a*, 15*b* each are used. The disk shields 14*a*, 14*b* are made from non-magnetic electrically conductive material, such as aluminum. The disk shields 14*a*, 14*b* are coaxially placed inside of the coil 12. Each disk shields 14*a*, 14*b* has a central opening 16*a*, 16*b* and one radial cut 18*a*, 18*b*. The cuts 18*a*, 18*b* of two adjacent disk shields 14*a*, 14*b* are 189 degrees offset from each other. The disk shields 14*a*, 14*b* are isolated from each other and from the coil 12.

Figure 1B:
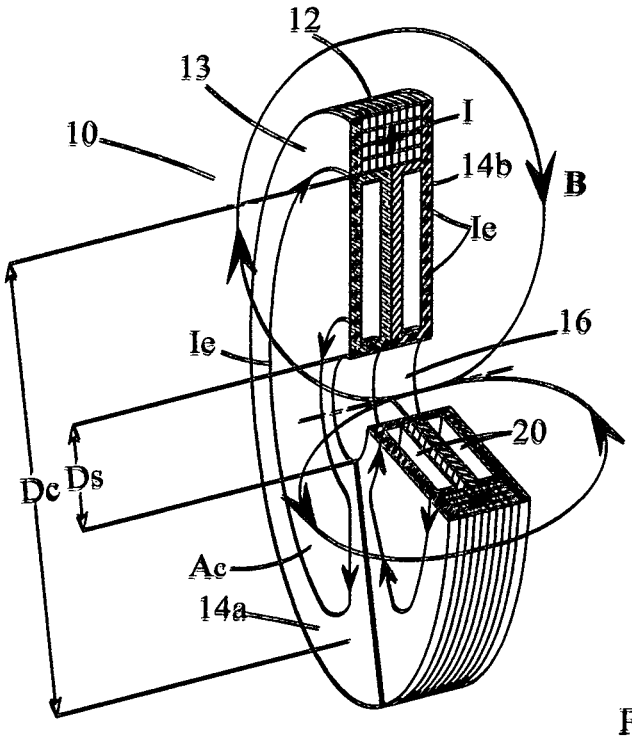
FIG. 1B is a cross-section of the MBM shown in FIG. 1A but assembling.

The entire magnetic flux with density B created by pulse current I of the coil 12 goes through the central opening 16 in the electromagnetic shield 13 due to eddy currents Ie from being generated in the disk shields 14*a*, 14*b*, see FIG. 1B, The eddy current Ie does not circuit around the axis of the coil 12. At the same time, without electromagnetic shield 13, the magnetic flux B will be passed through the area Ac, limited by the internal diameter Dc of the coil 12, The internal diameter Dc is larger than the diameter of central opening 16 Ds: Dc>Ds.

The disk shields 14*a*, 14*b* have cavities 29*a* and 20*b* respectively. They are filled with a coolant, for example, liquid nitrogen or cryogenic helium. The electrical conductivity of pure aluminum increases more than 19 times at liquid nitrogen temperatures and becomes a hyper or super conductor at helium temperatures (about 10K). In this case the disk shields 14*a*, 14*b* are paramagnetic with $\mu r=0$.

Figure 2:
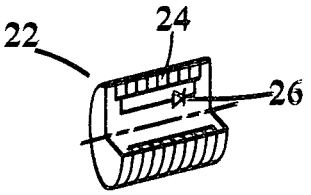
FIG. 2 illustrates a longitudinal section of the projectile with a cylindrical winding, shorted by a diode.

Referring to FIG. 2, the projectile 22 is made of a non-magnetic ($\mu r=1$), non-conductive ($\sigma[1/\Omega]=0$) material and is provided with a cylindrical winding 24, shorted by a diode 26.

Figure 3A:
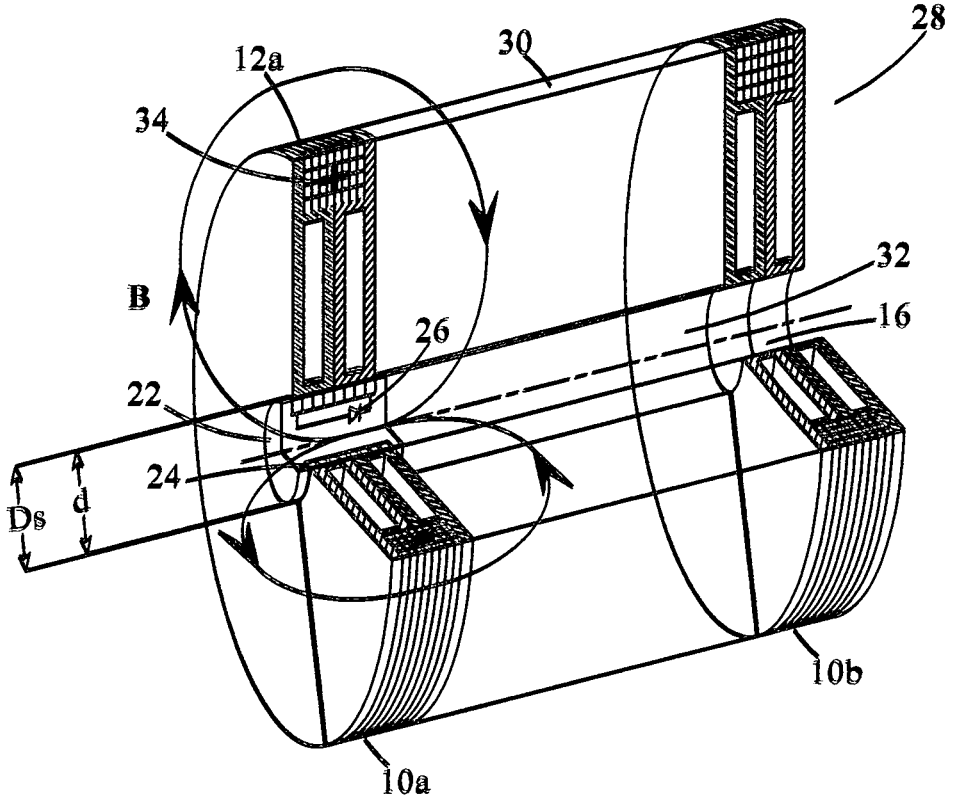
FIG. 3A illustrates an electromagnetic launcher, during of excitation of projectile winding.

An electromagnetic launcher 28 contains at least two MBMs 10*a* and 10*b* spaced from each other along the axis substantially coextensive with an intended trajectory of the projectile 22 and fixedly supported by non-conductive ($\sigma[1/\Omega]=0$), non-magnetic ($\mu r=1$) holder 39 with the same size of central opening 32 as the central opening 16 as shown in FIG. 3A. Conditionally in the drawings, the Holder 30 is shown transparent.

The inner diameter Ds of the central openings 16 and 32 is larger than the outer diameter d of projectile 22 to form a clearance to freely pass the projectile 22.

To excite the projectile winding 24 shorted by diode 26 the projectile 22 is axially aligned with first power coil 12*a* of MBM1 10*a* as shown on FIG. 3A. A pulse voltage is applied to first power coil 12*a* and increasing current 34 flows through first power coil 12*a* is created an increasing magnetic flux B flowing through the projectile winding 24. Direction of the projectile winding turns 24 and the polarity of the diode 26 are such that an electromotive force arises in the winding 24 of the projectile 22 is against the diode 26 and in this case the current in the winding 24 of the projectile 22 will not flow.

Figure 3B:
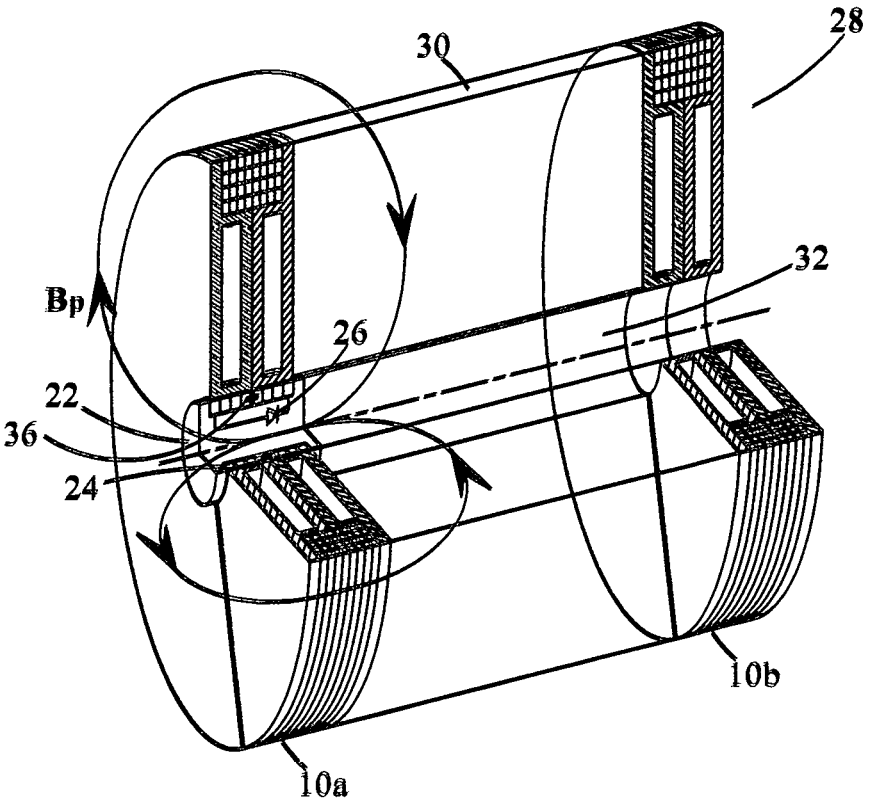
FIG. 3B illustrates the electromagnetic launcher with excited of projectile winding.

After the current 34 in the first coil 12*a* reaches its maximum value, this current and the magnetic flux created by it begin to decrease, which will lead to change in the sign of the electromotive force in the winding 24 of the projectile 22. Under the influence of this electromotive force, a current 36 will flow in the projectile winding 24 which creates a magnetic field Bp, as shown on FIG. 3B. In other words, part of the ampere turns of the first coil 12*a* will be pulsed transferred to the projectile winding 24. The current 36 will be held during the entire process of accelerating the projectile 22.

Instead of the diode 26, any suitable switch may be used to short the winding 24 of the projectile 22 at the moment of maximum magnetic flux B inside of the projectile.

Figure 4:
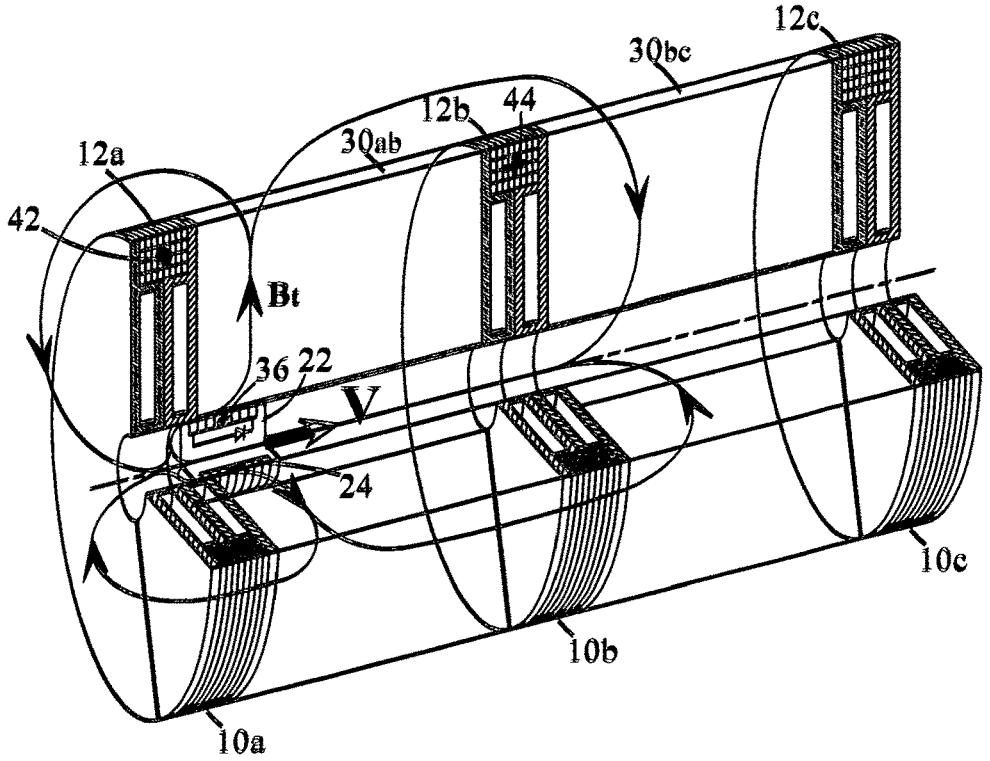
FIG. 4 illustrates the pushing-pulling action in the electromagnetic launcher with the projectile, located between the first and second power coils.

The process of excitation and then accelerating of excited projectile 22 will hereinafter be considered on the example of the EL consisting of three MBMs, as shown in FIG. 4. It is 10*a*, 10*b* and 10*c* respectively and two holders 30*ab* and 30*bc* respectively. After exciting the projectile winding 24 shown in FIGS. 3A and 3B, voltage pulses are simultaneously applied to the coils 12*a* and 12*b* of MBM2 10*a* and MBM2 10*b*, respectively, as shown on FIG. 4. The polarity of voltage pulse for first power coil 12*a* is opposite to the polarity of voltage pulse for first coil 12*a*, which was used to excite the projectile winding 24, and the polarity of pulse voltage for second power coil 12*b* is opposite to polarity of the pulse voltages for the first coil 12*a*. Due to currents 42 and 44 in the first and second power coils arising under the influence of these voltage pulses and current 36 in the projectile winding 24, between the first power coil 12*a* and the projectile winding 24 a pushing electromagnetic force is arisen and between the second power coil 12*b* and the projectile winding 24 a pulling electromagnetic force is arisen thereby accelerating the projectile 22 by the pushing and pulling electromagnetic force. These electromagnetic forces begin to accelerate the projectile 22 from MBM1 10*a* to MBM2 10*b*, see vector of speed V. The configuration of the total magnetic field Bt of EL created by these currents and by the current 36 in winding 24 of the projectile 22 are shown on FIG. 4.

When the projectile 22 reaches the center of MBM2 10*b*, the currents in the coils 12*a* and 12*b* should be zero. At the next moment, voltage pulses are simultaneously will be applied to the coils 12*b* and 12*c* of MBM2 10*b* and MBM3 10*c*, respectively. The projectile 22 continue to accelerate between MBM2 10*b* and MBM3 10*c* and etc. Any number of sections can be used, even an unlimited number.

Thus, in the considered PPEL, the magnetic fields at each moment of time exist only between two neighboring MBMs, where the projectile 22 is located at that moment. Therefore, there is no unproductive accumulation of magnetic energy, which is observed in an ordinary railgun and which dissipates in the form of a muzzle flame, reducing the efficiency of the railgun. Also in PPEL there is no energy loss due to the friction, since the projectile 22 moves within the openings 16 and 32 without physical contact. In addition, magnetic fields in PPEL create magnetic pressure hundreds of times greater than in any known EL.

For example, in the known coil gun the magnitude of the magnetic field is one Tesla. Magnetic pressure is defined as $B^2/(2\mu_o)$, where B is the magnetic flux density [Weber/$m^2$=Vs/$m^2$=Tesla]; $\mu_0=4\pi$ (−7) [Ωs/m=Henry/m]–vacuum magnetic permeability. Indeed, $B^2/(2\mu_o)$ $[(Vs/m^2)^2/(\Omega s/m)=V^2s/\Omega m^3=Ws/m^3=J/m^3=N/m^2=Pa]$–the magnetic pressure and magnetic energy per unit volume are the same, which is true for other types of energy. One Tesla creates a magnetic pressure of ~4 at.

Due to the disk shields 14 in PPEL the magnetic field inside of channel 32 will be increased in $(Dc/Ds)^2$ times, where Dc is inner diameter of coil 12 and Ds is diameter of opening 14, see FIG. 3A. For Dc/Ds=10 magnetic field will be 100 Tesla, and magnetic pressure of 40,000 at.

The PPEL parameters are selected in such a way that the time of the projectile 22 between two MBMs is much less than the time of penetration of the magnetic field into the body of the disk shields 14. This is achieved by cooling the disk shields 14 to nitrogen or helium temperatures. Due to this, firstly, the maximum magnetic field in the EL is achieved and, secondly, it contributes to the smooth dissipation of the magnetic field with the current dissipating in the coils of MBMs, i.e. the magnetic field does not get stuck in the disk shields 14 of MBMs, because it does not have enough time to penetrate them. The ideal situation is when the current pulses in the coils 12 of MBMs take on zero values when the projectile 22 is in the center of this MBM of EL. This will be in the form of current pulses close to a sine wave.

Figure 5A:
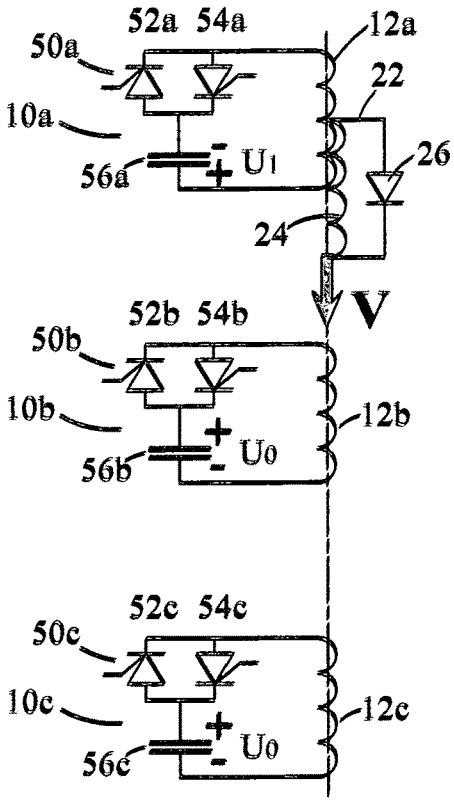
FIG. 5A is a sinusoidal current source with preliminarily charged capacitors.

A sample of sinusoidal current sources with preliminarily charged capacitors for PPEL with 3 MBMs shown on FIG. 5A. Currents and voltages diagrams for this case are shown on FIG. 5B. The thyristor switch 50 of each MBM contains two thyristors 52 and 54, respectively. It is 50*a*, 50*b* and 50*c*, and 52*a*, 54*a*, 52*b*, 54*b* and 52*c*, 54*c* for 3 MBMs respectively. They control a pre-charged capacitor 56*a*, 56*b*, 56*c* are connected in series with the coils 12*a*, 12*b*, 12*c* of MBMs 10*a*, 10*b*, 10*c* respectively.

Figure 5B:
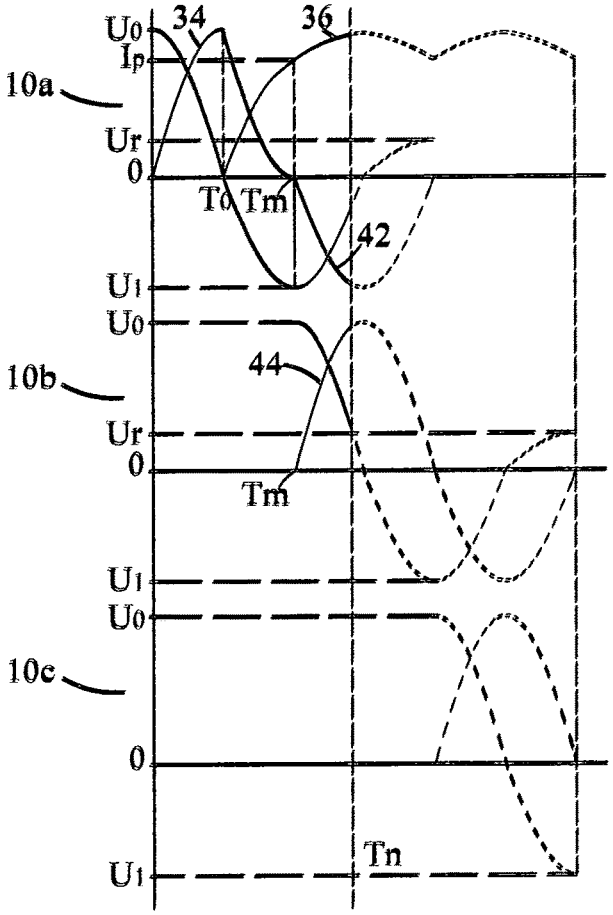
FIG. 5B is currents and voltages diagrams of a sinusoidal current source with preliminarily charged capacitors during acceleration of the projectile.

The process of exciting the projectile winding 24 takes place over a period from 0 to Tm as shown on FIG. 5B. After thyristor 52*a* is turned on during the time from 0 to $T_0$ capacitor 56*a* is discharged from $U_0$ to zero and the current 34 in Coil 12*a* is increased from zero to maximum. In the period between $T_0$ and Tm, the capacitor 56*a* is recharged to $U_1$, the current 34 in Coil 12*a* is reduced to zero and current 36 in the projectile winding 24 is increased from zero to $I_p$.

The beginning of the acceleration of the projectile 22 occurs at time $T_m$. At the time $T_m$, thyristors 54*a* and 52*b* are simultaneously turned on. Under the action of voltage $U_1$ on capacitor 56*a*, current 42 will flow in the coil 12*a*. And under the action of voltage $U_0$ on the capacitor 56*b*, a current 44 will flow in the coil 12*b* see FIGS. 4, 5A and 5B. The pushing and pulling electromagnetic forces accelerate the projectile 22 from MBM1 10*a* to MBM2 10*b* with speed V. In FIGS. 4, 5A and 5B show the moment corresponding to the time $T_n$ shown in FIG. 5B.

The electric energy not used to accelerate the projectile will be stored in the capacitor with a voltage Ur, which is less than the initial voltage $U_0$.

The process of accelerating the Projectile 22 will continue between MBM2 10*b* and MBM3 10*c*, but without the cost of energy to excite the projectile winding 24. The same processes will be repeated in case of an increase in the number of MBM in the PPEL.

While the invention has been described with references to illustrative embodiments, it is no intended that the novel device be limited thereby, but that modifications thereof are intended to be included within the broad spirit and scope of the disclosure and the following claims and the appended drawings.

The invention claimed is:

1. An electromagnetic launcher comprising a projectile, said projectile configured to be non-conductive and non-magnetic, said projectile having a projectile winding shorted by a switch; a non-conductive, non-magnetic holder; at least two power coils spaced from each other along an axis substantially coextensive with an intended trajectory of said projectile and fixedly supported by said holder, each of said at least two power coils having an inner diameter $D_c$ defining a generally circular open coil area $A_c$ through which a magnetic flux can pass when current flows through each of said at least two power coils to inductively couple said magnetic flux to said projectile winding; an electromagnetic shield; said electromagnetic shield configured to be non-magnetic and electrically conductive, said electromagnetic shield positioned inside to each of said at least two power coils substantially blocking said circular open power coil area $A_c$ of an associated power coil, each of said electromagnetic shields having a central opening, wherein said central opening having a diameter $D_s$, wherein said diameter $D_s$ being smaller than a diameter $D_c$, wherein said diameter $D_s$ dimensioned to freely pass said projectile; each of said electromagnetic shields having at least one radial cut, said at least one radial cut configured to prevent the flow of eddy currents within each of said electromagnetic shields around said axis, wherein each said electromagnetic shields confining said magnetic flux created by each of said at least two power coils to flow only through said central opening of each said electromagnetic shield to thereby increase the concentration of said magnetic flux flowing through said projectile winding; and an electrical power supply circuit connected to said at least two power coils for selectively and sequentially applying pulse voltages to a first of said at least two power coils and a second of said at least two power coils to induce a pushing and pulling electromagnetic force arising between said at least two power coils and said projectile winding said pushing and pulling electromagnetic force configured to excite said projectile winding and accelerate said projectile.

2. The electromagnetic launcher of claim 1 wherein said electromagnetic shield consists of two non-magnetic, electrically conductive identical disk shields, said disk shields having flanges, wherein each of said disk shields placed inside of said each of said at least two power coils coil; wherein each of said disk shields having an opening that is aligned with said central opening to freely pass said projectile; and each said disk shield having at least one radial cut; wherein said at least one radial cut configured to prevent eddy currents from closing around said axis of each said coil of said at least two power coils; and wherein said at least one radial cut of said two adjacent disk shields being offset by 180 degrees each other.

3. The electromagnetic launcher of claim 1 wherein said switch is a diode.

* * * * *